United States Patent [19]

Taylor et al.

[11] 3,966,189

[45] June 29, 1976

[54] TOGGLING RETARD PAD

[75] Inventors: Thomas N. Taylor, Rochester; Wayne F. Schoppe, Webster, both of N.Y.

[73] Assignee: Xerox Corporation, Stamford, Conn.

[22] Filed: Sept. 5, 1974

[21] Appl. No.: 503,541

[52] U.S. Cl. ..... 271/34; 271/167

[51] Int. Cl.[2] ..... B65H 3/04

[58] Field of Search ..... 271/6, 7, 10, 34, 35, 271/122, 124, 125, 167

[56] References Cited

UNITED STATES PATENTS

| | | | |
|---|---|---|---|
| 664,340 | 12/1900 | Sturtevant | 271/34 |
| 694,039 | 2/1902 | Sturtevant | 271/34 |
| 1,385,468 | 7/1921 | Pflanze | 271/10 |
| 3,485,489 | 12/1969 | Lindquist | 271/34 |
| 3,768,803 | 10/1973 | Stange | 271/34 |
| 3,831,928 | 8/1974 | Davis | 271/35 |
| 3,895,791 | 7/1975 | Kramell et al. | 271/167 |

*Primary Examiner*—Richard A. Schacher
*Assistant Examiner*—Robert Saifer
*Attorney, Agent, or Firm*—Paul Weinstein; Clarence A. Green; James J. Ralabate

[57] ABSTRACT

A sheet feeding and separating apparatus is provided for separating individual sheets from a stack. The apparatus includes sheet feeding means and retard means engaging the feeding means to form a nip for sheet advancement therebetween. A means is provided for adjusting the nip force between the retard means and the feeding means which is responsive to the direction in which a sheet is being advanced. A first nip force is provided when a sheet is advanced in a first direction and a second and different nip force is provided when the sheet is advanced in a different direction.

15 Claims, 25 Drawing Figures

OPTICS
REGISTRATION SYSTEM
SENSOR SWITCH
TIMER
SHEET FEEDER
DRIVE
SCAN SOLENOID
RETARD CLUTCH
BUCKLE SYSTEM ENABLER
MACHINE STOP LOGIC
JAM LOGIC
TIME DELAY
SCAN CONTROLLER
STOP SWITCH
MASTER COUNTER
MACHINE CONTROLLER
OPTICS SENSOR
PRINT SWITCH
RETARD CLUTCH
LATCHING SWITCH
LATCH Q
COUNTER
MASTER COUNTER AND DECODER
BUCKLE SYSTEM ENABLER
+5V

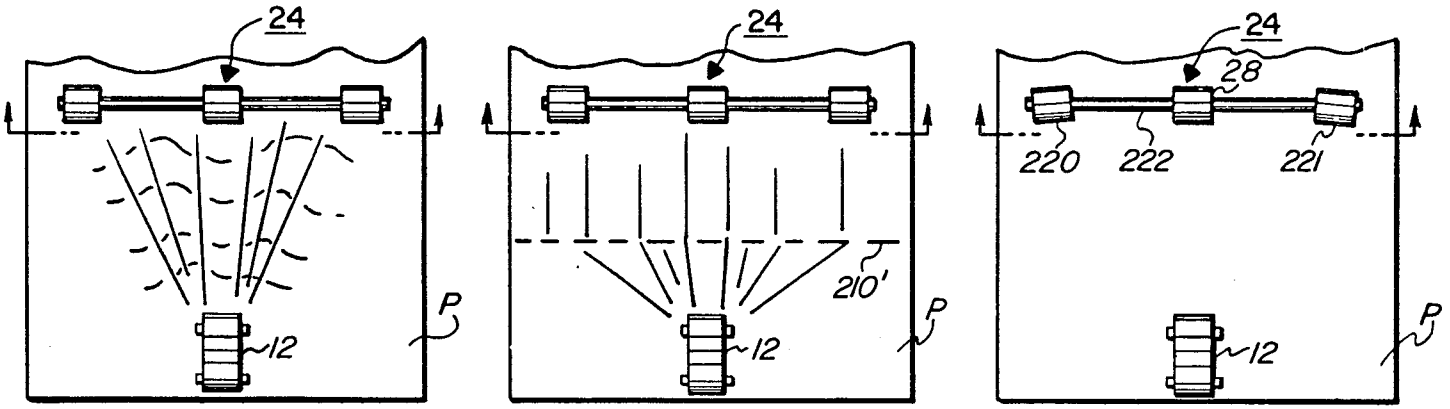
FIG. 16A
FIG. 17A
FIG. 18A
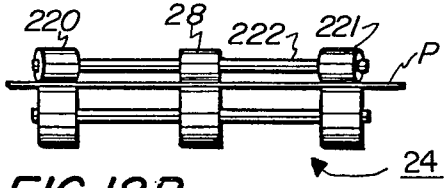
FIG. 16B
FIG. 17B
FIG. 18B
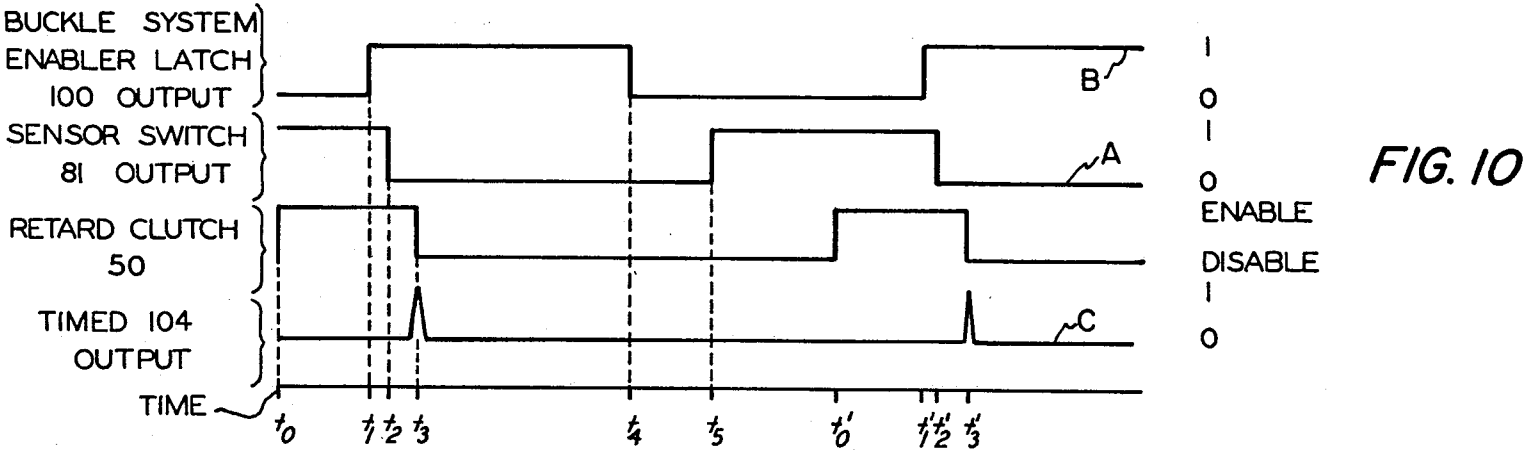
FIG. 10

TOGGLING RETARD PAD

CROSS REFERENCE TO RELATED APPLICATIONS

U.S. Pat. application, Ser. No. 503,584, filed Sept. 5, 1974, for a Buckle Control System, U.S. Pat. application Ser. No. 503,583, filed Sept. 5, 1974, for a Sheet Feeding Apparatus; U.S. Pat. application, Ser. No. 503,221, filed Sept. 5, 1974, for a Sheet Feeding Apparatus; and U.S. Pat. application, Ser. No. 503,413, filed Sept. 5, 1974, for a Sheet Feeding Apparatus.

BACKGROUND OF THE INVENTION

This invention relates to a sheet feeding apparatus and reproducing machine using that apparatus wherein a friction retard separating and feeding means is employed.

A great variety of friction retard type feeders have been utilized in the prior art. One particularly unique design for a friction retard separator which has proved to be a highly reliable means for feeding individual sheets one at a time from a stack is described in U.S. Pat. No. 3,768,803 assigned to the assignee of the instant invention. In the disclosed separator a feed belt is supported for movement about a pair of pulleys. A curved retard means is positioned against the unsupported section of the belt between the pulleys to form a sheet queing throat or nip. The belt contacts the stack near the edge and the throat acts to que or align the sheets for advancement into the sheet handling system. In this approach only the top most sheet is fed through the separator, however, adjacent sheets are shingled in the throat formed between the belt and the retard pad. A given level of nip force is exerted between the retard means and the feed means in order to obtain proper sheet separation.

If one desires to clear a jam in the paper feeder or to change sheet stacks it is generally necessary to also remove one or more sheets which are shingled in the nip of the separator feeder. This is a problem common to most friction retard type separators.

2,635,874 approach to solving this problem is illustrated in U.S. Pat. No. 2,635,974 wherein a retard roll is mounted to be pivoted away from engagement with the feeder. In U.S. application Ser. No. 398,024, filed Sept. 17, 1973, now U.S. Pat. No. 3,883,133, and assigned to the assignee of the instant invention. A roll type friction retard separator is provided wherein the retard roll can be pivoted away from the feed roll by the operator in order to clear jammed or shingled sheets. In U.S. Pat. application Ser. No. 342,653, filed Mar. 19, 1973, and assigned to the assignee of the instant invention, a retard pad and belt feeder are provided wherein the pad may be pivoted out of position to facilitate unloading of the stack support tray.

Each of these approaches require operator involvement to separate the nip of the separator for clearing a sheet shingled therein. In a compact environment such as might be found with a desk type copier there may not be sufficient room to allow access by the operator for the purpose of pivoting the retard means away from the feeder.

SUMMARY OF THE INVENTION

In accordance with this invention an improved sheet feeding and separating apparatus is provided as well as a reproducing machine employing such an apparatus.

The apparatus includes means for feeding and separating sheets from a stack and retard means engaging the feeding means to form a nip for sheet advancement therebetween. A means is provided for automatically adjusting the nip force between the retard means and the feedng means in response to the direction in which a sheet is being advanced through the nip. A first nip force between the retard means and the feeding means is provided when a sheet is advanced in a first direction and a second and different nip force between the retard means and the feeding means is provided when a sheet is advanced in a second direction different from the first direction. The first nip force generally comprises the desired force level for obtaining proper sheet separation and the second nip force is generally lower to allow removal of sheets from the nip. The first direction comprises the sheet feeding direction and the second direction is generally opposed to that direction.

Accordingly, it is an object of this invention to provide an improved sheet feeding and separating apparatus.

It is a further object of this invention to provide an automatic means for adjusting the nip force of a friction retard feeder/separator.

It is a still further object of this invention to provide a reproducing machine including the improved sheet feeding apparatus. These and other objects of the invention will become more apparent from the following description and drawings.

BRIEF DESCRIPTION OF THE DRAWINGS

FIG. 10 is a timing diagram for the electrical buckle height control system of this invention.

FIGS. 16A and 16B are a top and front view illustrating the effect of a sheet being held simultaneously in registration rolls and a separator.

FIGS. 17A and 17B are a top and front view illustrating the effect of a pre-registration bump in the sheet feed path.

FIGS. 18A and 18B are a top and side view illustrating the use of toed out registration rolls.

DETAILED DESCRIPTION OF THE PREFERRED EMBODIMENTS

In order to utilize a friction retard separator of the type described in U.S. Pat No. 3,768,803, in a sheet feeder which would be adapted for use in a compact reproducing machine such as a compact xerographic copier, various improvements have been provided to enable its efficient use. In a compact unit the sheet feeder components, the registration mechanisms, and the imaging device are all presented in a short paper path. Therefore, a sheet being fed by the registration rolls may still have a portion held within the nip of the separator. Since the registration rolls feed the sheet to the imaging member, it is necessary that the action of the separator on the trailing portion of the sheet not interfere with the smooth operation of the registration rolls, and further, that it not interfere or cause a force distribution which will result in rippling of the sheet particularly in the transverse direction. Such rippling of the sheet results in copy quality defects in the form of finger-like deletions in the resulting copy sheet.

Most xerographic type copiers use an on-center separator, namely, a separator which feeds sheets from the transverse center of the stack. The use of on-center feeding requires center registration on the viewing platen for original documents which are being copied. In newer machines such as the Xerox 3,100 compact copier, a corner registration arrangement has been employed for original documents which has resulted in the use of a sheet feeder arrangement wherein the stack is registered against one side of the feeder. In this type of device the sheet separator for many of the sheet sizes being fed is off-center with respect to the stack.

It has been found that when a sheet separator of the type described in the aforenoted patent is utilized for off-center feeding. There is a tendency for the sheet being fed to skew. This skewing tendency can be off-set to a great degree by properly edge guiding of the sheets during feeding. The skew which still persists can then be taken out by forward buckling the sheet into a suitable registration gate.

The sheet feeding apparatus which will now be described in detail has been designed for use in a compact environment. It has been shown to be highly reliable with a low propensity for jamming and misfeeding. The various improvements which will be described hereinafter are shown in an overall sheet feeding apparatus which comprises a preferred embodiment of this invention. It should be apparent, however, that these improvements generally have wide application in the sheet feeding art and, therefore, are not necessarily limited to the specific type of sheet feeding apparatus to be described.

Figure 1:
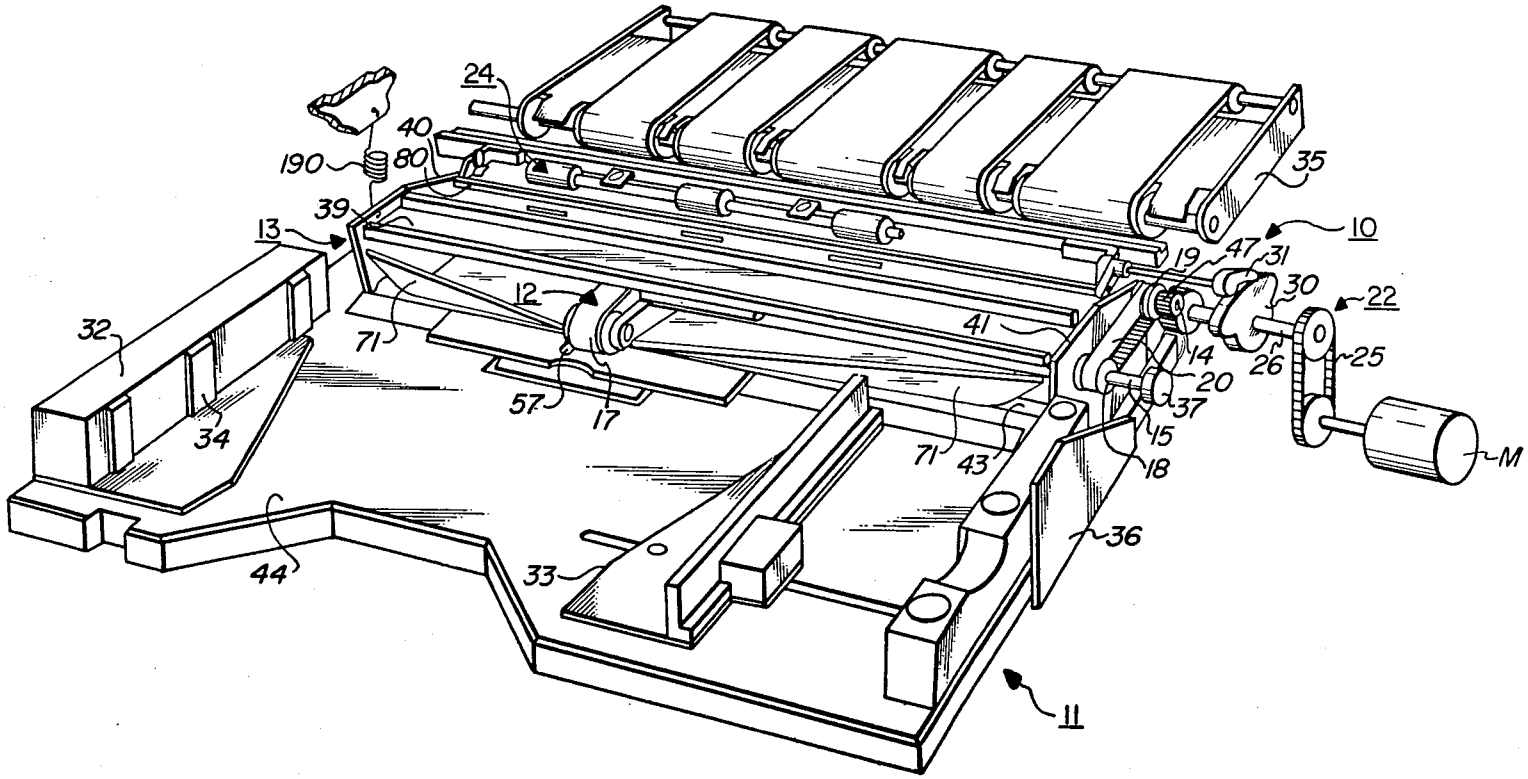
FIG. 1 is a perspective view of a sheet feeding apparatus in accordance with one embodiment of the present invention in its operative position.
Figure 2:
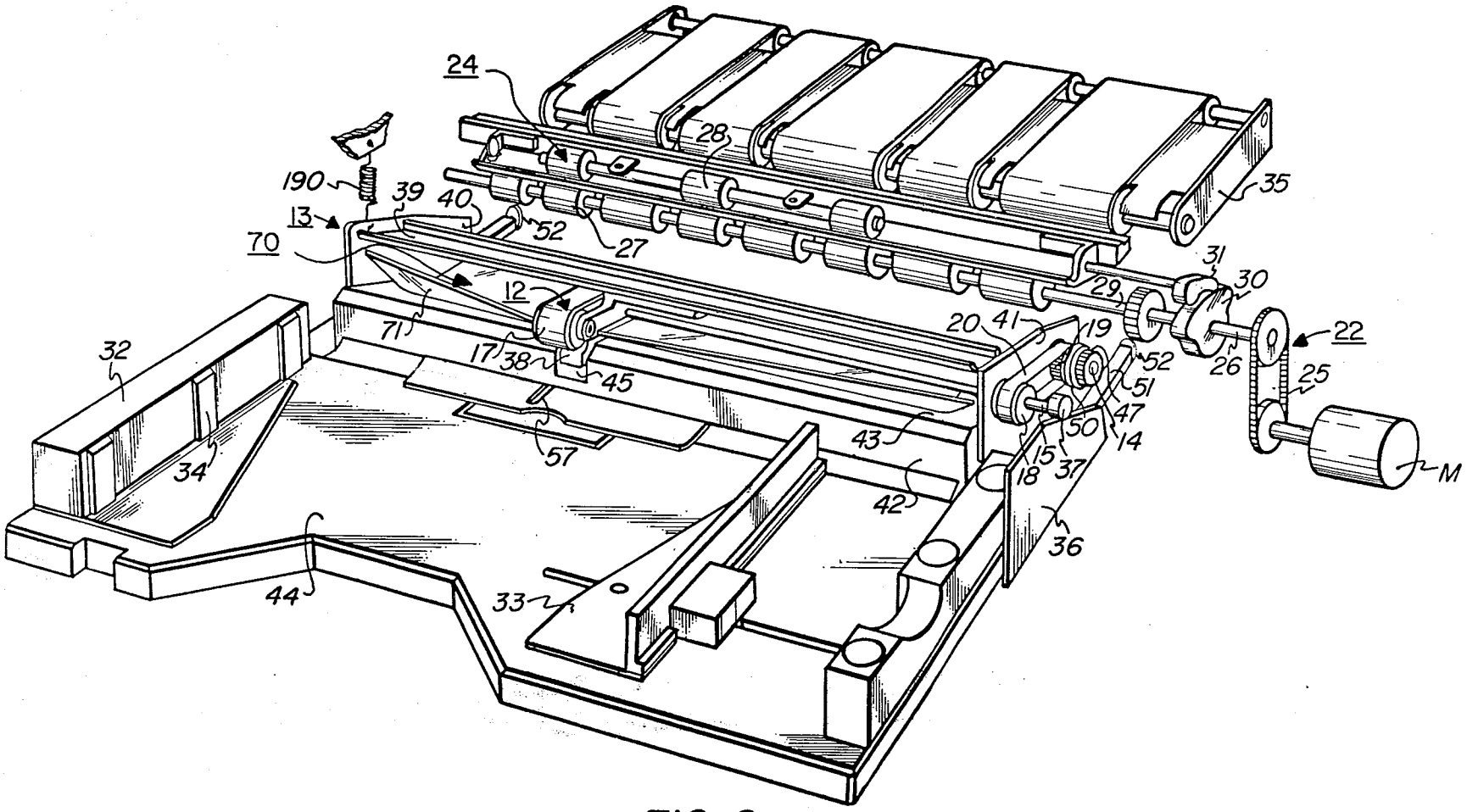
FIG. 2 is a perspective view of the sheet feeding apparatus of FIG. 1 with the paper drawer extended.

Referring now to FIGS. 1–3, the elements of the sheet feeder 10 of this invention will be described. The feeder includes a sheet support drawer 11 for supporting a stack of sheets. While a top feeder is shown in these Figures the various elements of the invention of this application are generally applicable to bottom feeders as well as top feeders.

A friction retard separator 12 having a design similar to that set forth in the above-noted U.S. Pat. No. 3,768,803 is provided. The separator is supported in a pivoting frame element 13 which pivots about the axis of a stub shaft 14. The drive for the separator 12 is provided by means of a shaft 15 connected to the rear pulley 16 of the belt feeder 17 at one end and which has a timing belt pulley 18 secured to its other end. A second timing belt pulley 19 is journaled for rotation about stub shaft 14, and a timing belt 20 connects both pulleys. A drive gear 47 is secured to pulley 19 and is journaled about shaft 14. A drive system 22 engages the gear 21 to drive the belt feeder 17.

Following the separator 12, a pivoting registration gate 80 and registration pinch rolls 24 are provided to first enable a sheet to be forward buckled to remove any residual skew, and to then feed the sheet in timed relation to a suitable imaging member. A motor M is provided in the drive system 22 to drive the registration rolls 24 by means of a chain drive 25 connected to the shaft 26 of the lower registration rolls 27. The upper registration rolls 28 idle on shaft 29 against the lower registration rolls 27. A cam 30 and follower 31 arrangement is utilized to pivot the registration gate 80 about the axis of shaft 23 in and out of sheet blocking position in the sheet feed path.

Figure 14:
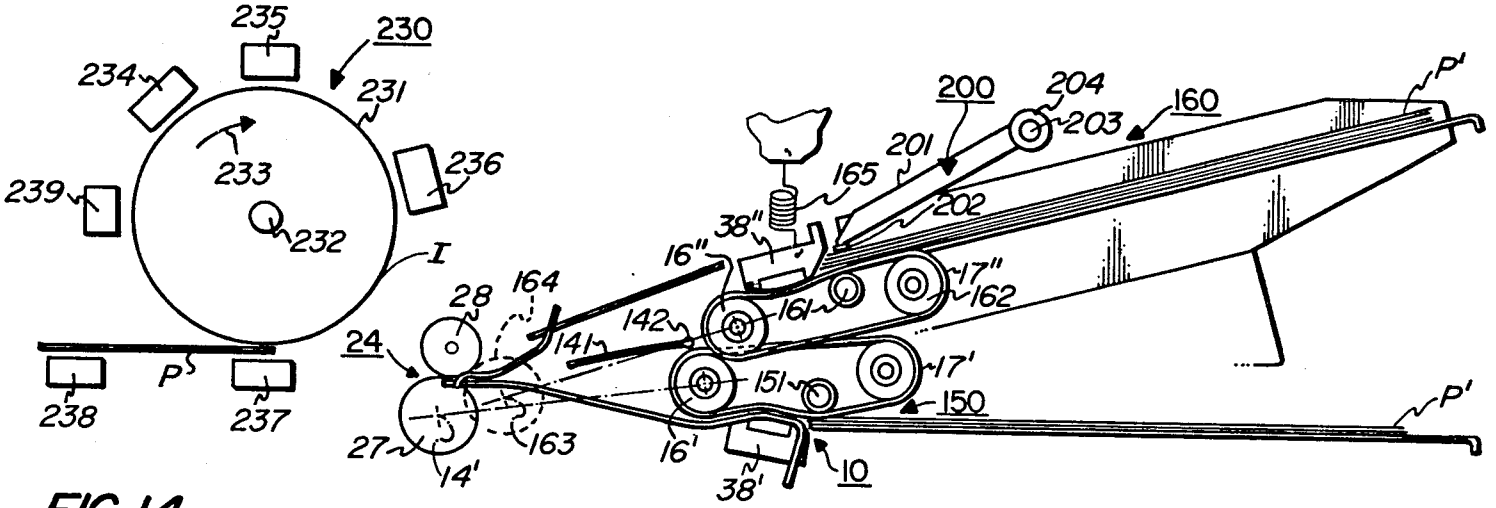
FIG. 14 is a schematic side view of a reproducing apparatus incorporating a bottom feeder and a top feeder in accordance with this invention.

The feeder 10 shown in adapted for use with a corner registered reproducing machine and, therefore, the stack is registered against a first stationary side guide 32. An adjustable second side guide 33 is provided for engaging the opposing side of the stack. Restraining means 34 are provided, such as described in U.S. Pat. application Ser. No. 433,623, filed Jan. 16, 1974, and assigned to the assignee of the instant invention for restraining the edges of the sheets in the stack in order to provide efficient edge guiding of the sheets as they are fed by the separator 12. As previously described depending on the width of the sheets being fed, the feeder-separator will either be on-center or off-center with respect to the transverse width of the sheets in the stack and, therefore, proper edge guiding is required to minimize skew due to the feeder. An imaging member I such as a xerographic drum as shown in FIG. 14 generally follows the registration rolls 24 in the sheet feed path. The imaging member I is not shown in FIG. 1. Following the imaging operation, a sheet transport 35 such as a vacuum transport is utilized to carry the sheet away from the imaging member.

A stationary cam 36 and sliding follower 37 arrangement are utilized for pivoting the separator 12 out of communication with the stack when the drawer 11 is withdrawn to its extended position for loading and unloading sheets as well as for clearing any jams or misfeeds which might have occurred. Referring to FIG. 2, the paper drawer arrangement 11 is shown in its extended position. In the extended position the paper drawer 11 has been withdrawn outwardly from its operative position a sufficient distance to allow access to a stack of sheets supported thereon. In addition, the separator 12 has also been withdrawn to the extended position to allow access to any sheets that might remain shingled in the nip of the separator. The separator 12 is pivoted up to a position out of contact with the stack by means of the action of the follower 37 and 36 previously described. The separator 12, as a unit comprising the belt feeder 17, and retard pad 38, is secured to the top bar 39 of the pivoting frame 13 structure. The side plates 40 and 41 are pivoted about the axis of the shaft 14. The side plate 41 is suitably journaled for rotation about the shaft 14 and the side plate 40 is pivotally pinned to the drawer 11 frame, not shown.

One of the novel features of this invention comprises the provision of a loading baffle 42 positioned to be pivoted into operative position when the separator 12 is cammed out of contact with the stack. The loading baffle 42 is supported by the pivoting side plates 40 and 41 and in the embodiment shown comprises an integral part of the lower paper chute 43. The provision of a pivotal loading baffle 42 provides a convenient means for registering the leading edge of a stack of sheet material on the support tray 11. The stack is registered up against the loading baffle 42 as well as the fixed side guide 32. The adjustable side guide 33 is then pushed into engagement with the free side of the stack. This eliminates any necessity for having a support for the trailing edge of the stack and provides a good means for accurately locating the lead edge of the stack with respect to the position of the separator 12.

Figure 3A:
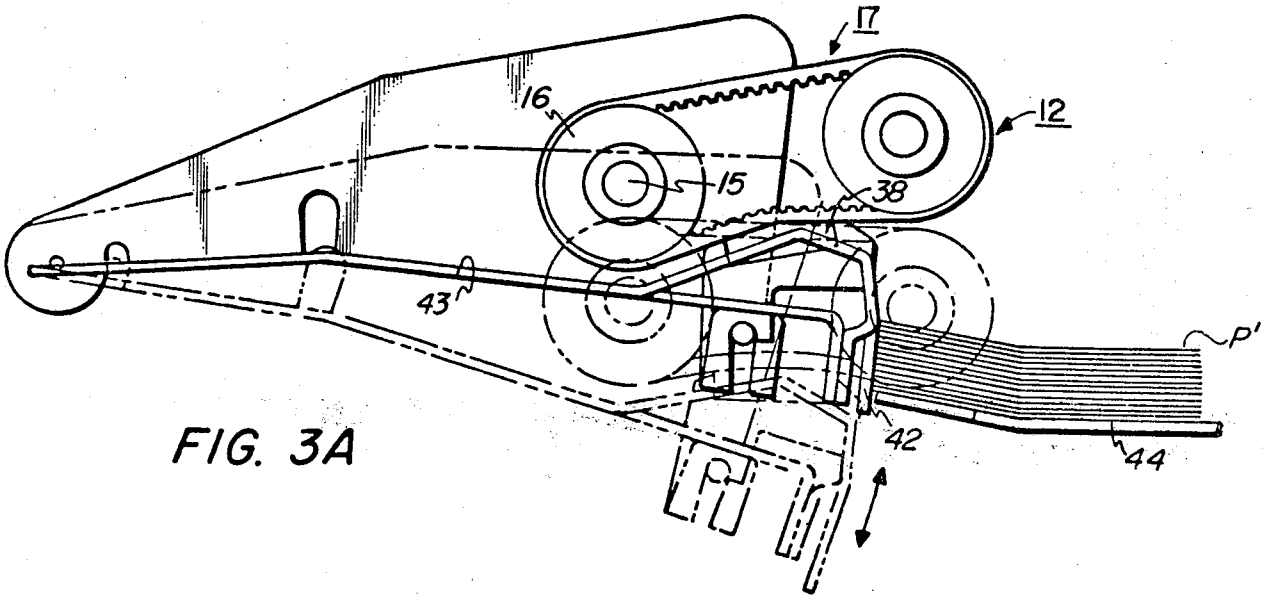
FIGS. 3A and 3B are a series of partial side views of the sheet feeder of the present invention.
Figure 3B:
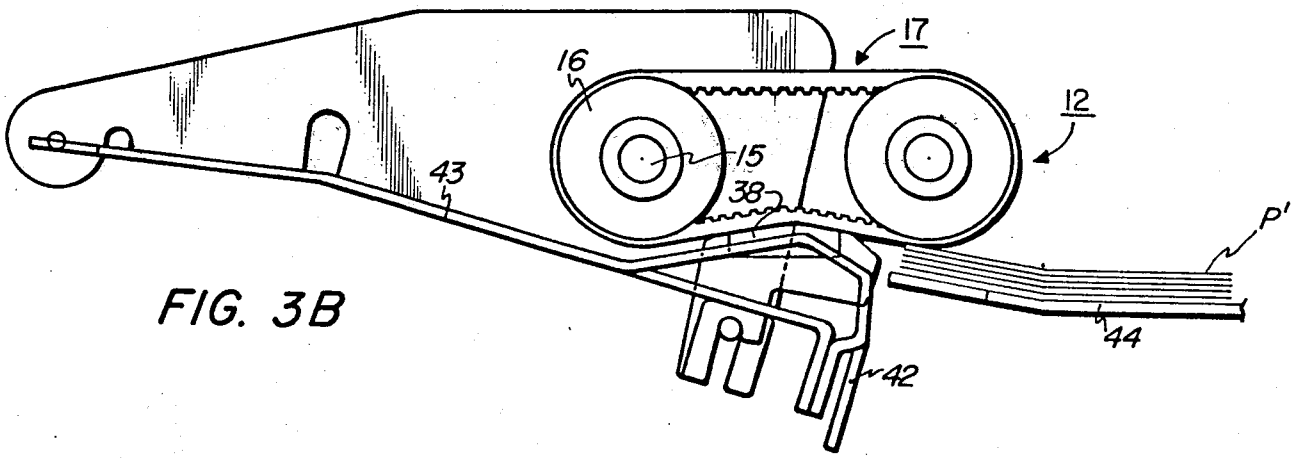

The pivotal operation of the loading baffle 42 of this invention is best illustrated in FIGS. 3A and 3B. In FIG. 3A the separator 12 in solid lines has been pivoted to the loading position by the action of the cam 36 and follower 37. In this position the baffle 42 has a sufficient height with respect to the support tray 44 so that the full height of the paper stack P′ to be employed can be placed against it. The retard pad 38 of the separator 12 is positioned against the back side of the baffle 42 and extends through a slot 45 in the baffle to be adjacent the stack. The baffle shown extends across the length of the front edge of the stack. The full range of motion of the separator 42 is shown in FIG. 3A, while in FIG. 3B, the separator and baffle are shown in an operative position for an intermediate stack height. The shape of the lower paper chute 43 which is formed as an integral part of the baffle 42 in the apparatus shown will be described in greater detail later.

It is apparent from FIG. 3 that the separator 12 is adapted to pivot through the full range of stack heights. In the apparatus shown this range comprises about 13° from the horizontal.

Figure 4:
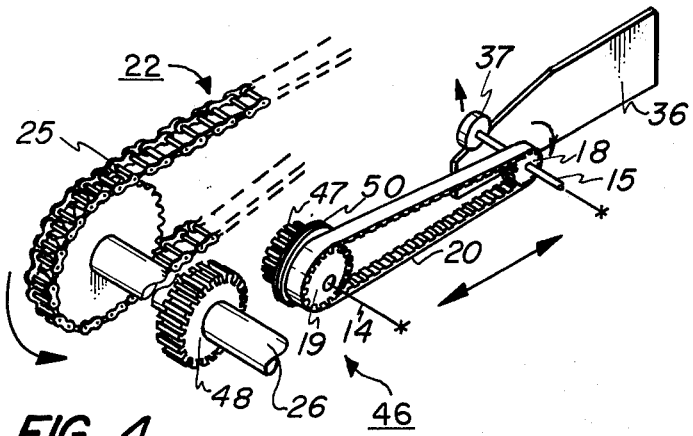
FIG. 4 is a partial perspective view illustrating the make-brake drive of the present invention.
Figure 5A:
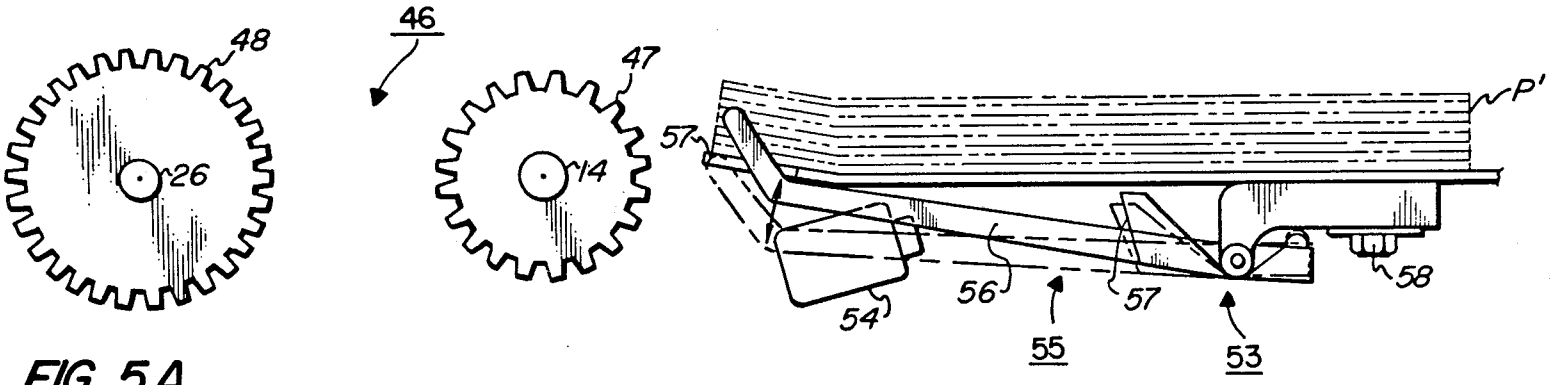
FIGS. 5A and 5B are a series of partial side views illustrating the combination out of paper and drive make-brake sensing switch of the present invention.

Referring now to FIGS. 2, 4, and 5, it is apparent that since the separator 12 is carried along with the sheet support drawer 11 to the extended position a make-brake drive connection 46 is necessary for driving the belt of the feeder. In the embodiment shown the make-brake drive 46 comprises a pair of gears 47 and 48 which mesh when the paper drawer 11 is in its operative or sheet feeding position, and which go out of mesh when the paper drawer is in its extended or reloading position. The gear 48 is secured to the shaft 26 and the gear 47 is journaled about shaft 14. The gear 47 is coupled to the pulley 19 through an electrically operated clutch 50. The pulley 19 is coupled by means of timing belt 20 to the shaft 15 which is connected to the rear pulley 16 of the belt feeder 17.

The sheet support tray 11 is adapted to slide on rails 51 as shown in FIG. 2 between the operative position and the extended position. Adjustable abutment screws 52 at the ends of the rails 51 provide a means for adjusting the position and skew of the separator 12 with respect to the registration rolls 24 in the sheet feeding path.

Figure 5B:
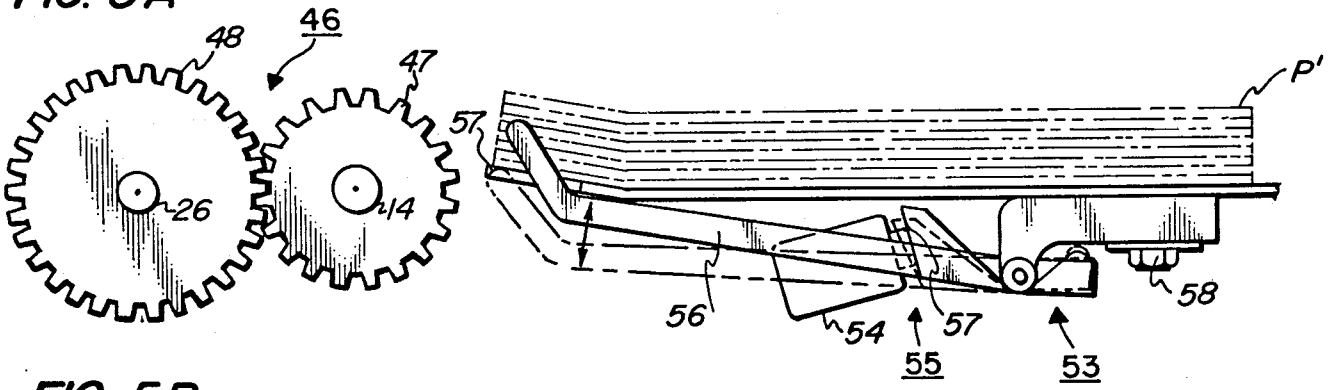

Another of the improved elements of the present invention is the utilization of a single switch actuator and switch 53 for detecting both out of paper conditions as well as meshing engagement of the make-brake drive mechanism 47 and 48. Referring now to FIG. **5*a* the gears 47 and 48 of the make-brake drive are shown separated which would correspond to the extended position for the paper drawer 11. In this position the microswitch 54 could not be actuated. This is the case even if a paper stack were placed on the support tray and were caused to depress the switch actuator 55 as shown by the dotted lines. When the paper tray is pushed into the machine to its operative position where sheet feeding can take place, the gears 47 and 48 are meshed as shown and the switch actuator 55 is in position to engage the microswitch 54 detector. As shown in FIG. 5b, when no stack is present on the support tray, the microswitch 54 is not actuated since the lever arm 56 of the actuator 55 sticks up through the slot 57 in the tray. Upon placing a stack of sheets on the tray the arm 56 is depressed as shown by the dotted lines which actuates the switch 54 and provides a signal which indicates both that paper is present and that the make-brake drive is engaged. Actuation of the switch 54 requires concurrent engagement of the make-brake drive 46** and presence of sheet material.

In order to accomplish this simultaneous operation, the actuating lever 56 for the switch 54 is mounted to the bottom side of the support tray while the switch itself is mounted to a stationary feeder frame (not shown) upon which the support tray slides. The actuating lever itself has one end pivotally mounted to the bottom of the support tray and the other end arranged to protrude through the slot 57 in the support tray when there is no stack of sheets supported on the tray. At the end of the lever actuator adjacent to the pivot point, a cam portion 57 is provided for engaging the switch 54 when the tray is in its operative position. The cam portion pivots against the actuating button on the switch to open or close the switch as desired. When the tray is withdrawn to its extended position the cam portion 57 of the lever 56 is withdrawn from possible engagement with the switch 54. The lever 56 is adjustably mounted by means of the screw 58 to the bottom of the support tray so that the cam 57 can be positioned to engage the switch button and actuate the switch 54 only when the make-brake drive is in proper meshing engagement. In this way the switch is operative to detect both the drive connection and an out of paper condition.

Another feature of the improved sheet feeding apparatus of this invention comprises the use of a toggling type retard pad. As previously described, the sheet separator preferred for use with this invention is described in the previously noted U.S. Pat. No. 3,768,803. It employs a queing throat into which the sheets are shingled in order to separate the top sheet from the remaining sheets. Since both the belt feeder 17 and the retard pad 38 travel with the support tray 11 to the extended position, and further since the nip between the belt and the retard pad does not separate, it is likely when changing sheet stacks that one or more sheets will be shingled in the nip form between the belt feeder and the retard pad. One of the principle reasons for desiring the sheet separator 12 to extend from the reproducing machine in the same manner as the paper drawer 11 is to provide access to such shingled sheets. The nip force between the retard pad 38 and the belt feeder 17 must be at some desired level in order to provide sheet separation. This nip force has been found to create some difficulty when pulling out sheets which are shingled in the nip as, for example, when changing paper or clearing jams.

Figure 6:
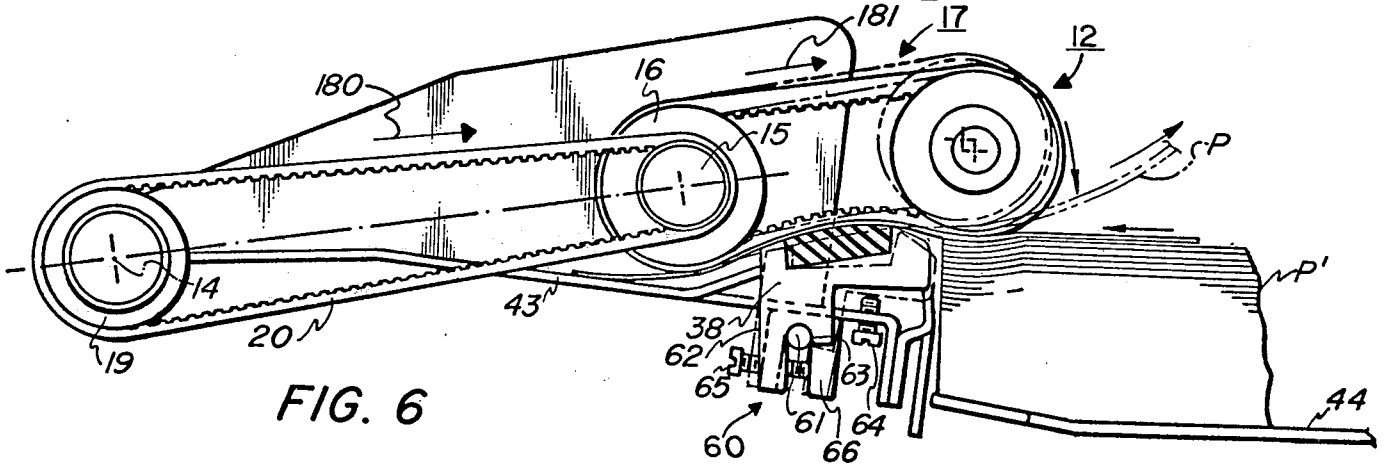
FIG. 6 is a partial side view of the sheet feeder of this invention.

Therefore, in accordance with this invention a means has been provided for automatically reducing the nip force between the retard pad 38 and the belt-feeder 17 when one is attempting to remove sheets in a direction opposed to the feeding direction and to automatically increase the nip force to the desired level when one is attempting to feed sheets in the sheet feeding direction. In accordance with one embodiment this is accomplished by a novel toggling linkage 60 for the retard pad 38 which is best shown in FIG. 6. As shown in FIG. 6, the retard pad 38 is pivoted about a pin 61 which extends transverse to the direction of sheet feed and transverse to the belt feeder. The retard pad is supported by a member 62 which includes a slot 63 in which the pin 61 rides to pivotally support the member 62. The pivot point for the retard support plate 62 is off-center of the plate in the downstream direction as shown. The support plate 62 is generally L-shaped with the long first leg of the L including the retard pad 38 being aligned with the belt feeder 17 and the short second leg of the L being disposed substantially perpendicular thereto and including the slot 63 defined by the fork-like projections which project about the pin and provide the pivotable mounting.

A first adjustment screw 64 is provided in threaded engagement with the bottom paper chute 44 of the pivoting frame 13 which abuts against the first leg of the plate 62 and provides the adjustment for the degree of pivoting motion to be permitted when a sheet is pulled in a direction contrary to the direction of sheet feeding. A second adjustment screw 65 is provided in one of the fork-like projections of the second leg of the support plate 62. The second adjustment screw is adapted to coact with a plate 66 fixed to the bottom of chute 44 as shown in order to adjust and limit the degree of motion for the retard plate 62 when a sheet is being fed.

By providing the pivot point off-set from the center of the retard pad in the direction of feed and by placing it downstream of the center line of the plate 62, movement of a sheet during sheet feeding in the direction of feed will cause the plate 62 to pivot or toggle in a counterclockwise direction around the pin 61 and thereby increase the deflection of the belt of the feeder 17 in the section between the pulleys, and automatically increase the nip force between the feed belt 17 and the retard pad 38 during sheet feeding. The degree of rotation of the plate is determined by the adjustable stop screw 65. Therefore, during sheet feeding a relatively higher nip force between the belt and the pad is obtained by pivoting the pad into the unsupported region of the belt and deflecting the belt to a greater degree. When one is trying to clear shingled sheets, or otherwise remove sheets from the nip of the separator 12 pulling the sheet out causes the toggling plate 38 to rotate in a clockwise direction up against the screw 64 so as to reduce the deflection of the belt 17 in the unsupported region and thereby reduce the nip force between the belt and the retard pad. In this manner, one obtains automatically a reduction in nip force when trying to pull out sheets from the nip of the separator and an increase in nip force to a desired level when one is attempting to feed sheets. By this simple toggling type linkage for the retard 38, one is able to eliminate the necessity for various approaches heretofore used requiring the operator to pivot the pad away from engagement with the feed means.

Figure 7:
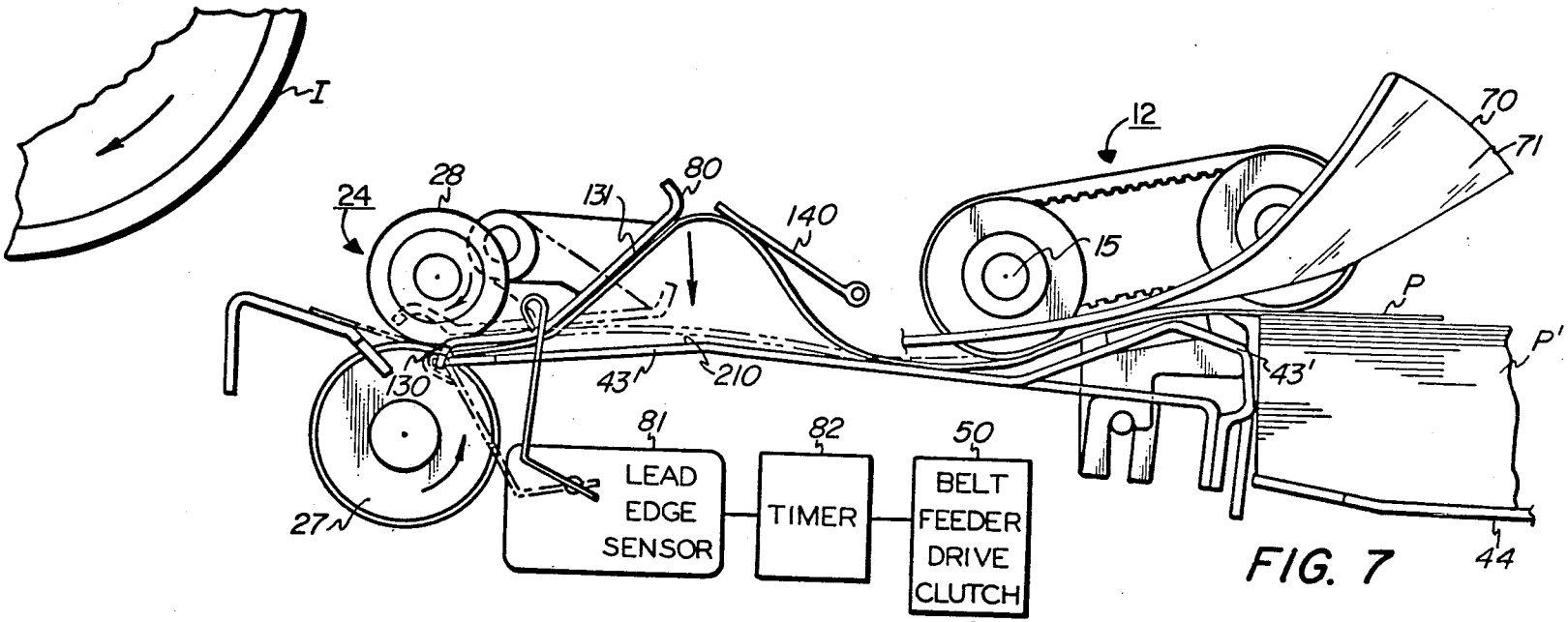
FIG. 7 is a partial side view of a sheet feeder in accordance with this invention.

Yet another preferred feature of the paper drawer and separator arrangement of the present invention, comprises an upper paper chute 70 which is adapted to guide sheets which may have curled edges. A problem associated with various copying machines, particularly those utilizing radiant fusing, is curl of the edges of the copy sheet. If one desires to refeed these sheets through the copier or other reproducing machine in order to obtain duplex copying or copying on both sides of the sheet it is difficult to obtain reliable sheet feeding without a high jam propensity. The upper paper chute 70 of the present feeder has been designed to take account of such curled type sheets wherein when they are being fed for the second time for copying on their second side, the curled edges would be facing up. In order to accommodate these curled edges and enable the sheets to be fed into the systems, dog-eared portions 71 are provided in the upper paper chute as shown in FIGS. 1, 2, and 7. The upstream corner portions 71 of the upper paper chute 70 are bent upwardly to provide an increased gap between the upper paper chute and the lower paper chute 44 to accommodate the curl at the edges of the sheets. The upper chute 70 shown is of a plate-like configuration which extends transversely across the sheet feed path and is generally coextensive with the belt feeder 17 in the sheet feeding direction. The chute 70 is secured to the pivoting frame 13 by conventional means (not shown). The upper paper chute 70 generally conforms to the lower paper chute 44 in order to feed sheets over the desired sheet feed path. The upwardly extending dog-eared portions 71 enable the uniform feeding of sheets having curled edges.

Referring now to FIG. 7, following the sheet separation the sheet is fed along the sheet feed path defined by the upper 70 and lower 44 paper chutes and then over the lower paper chute until it reaches and engages a pivoting registration gate 80. The sheet continues to be fed until a comparatively high forward buckle is obtained, as shown. The large forward buckle formed generally has a height to length between constraining point ratio of about 1 to 4, and preferably about 1 to 6 to eliminate any residual skew which may be present due to the feeding of the sheet separator. To obtain uniform buckle heights if the sheet feeder is to operate consistently to eliminate skew. It is recognized, of course, that skew is bad for a reproducing machine since it results in misregistered images and also in jamming of sheets in downstream processing stations.

One of the problems with utilizing a belt and pad friction retard separator wherein the next to be fed sheet may be shingled in a queing throat, is that the lead edge of the sheet is not at a definite location. Therefore, if one employs a fixed time for buckle height formation, then depending on where the lead edge of the sheet is in the nip prior to the feed cycle, the resulting buckle height will vary to quite a large extent. Detection of the actual buckle height is also difficult because of the fact that the high point of the buckle may appear at different locations along the sheet feed path depending on the thickness of the material being fed, and also on the type of material. For example, labels and other types of similar materials buckle at odd positions as compared to a paper sheet. Therefore, in accordance with a preferred embodiment of this invention it is proposed to obtain uniform buckle heights and, therefore, optimum results as far as skew elimination is concerned by sensing the lead edge of the sheet and then providing a desired time interval for buckle height formation from the time the lead edge is sensed. To accomplish this a switch 81 is placed in the sheet feed path which will be intercepted prior to the lead edge of the sheet intercepting the registration gate 80. The switch shown is shown closely adjacent to the registration gate, however, that position could be varied and the switch could have been placed close to the separator, if desired. The lead edge of the sheet being fed closes the switch 81 and causes a timer 82 to count off a reference time interval during which the sheet separator 12 continues to feed. After expiration, the reference time interval the sheet separator 12 is deactivated by means of the electric clutch 50. It should be apparent that while a lever type switch 81 is shown as the lead edge sensor, other types of detectors could be employed including photodetectors. A lever switch has the advantage that it is not affected by the feeding of transparent materials such as transparencies. The timer 82 may be of any desired design. In accordance with this invention it has been found to be preferable to incorporate the timer into the machine control system in such a way that an electronic timer is utilized.

Figures 8, 9:
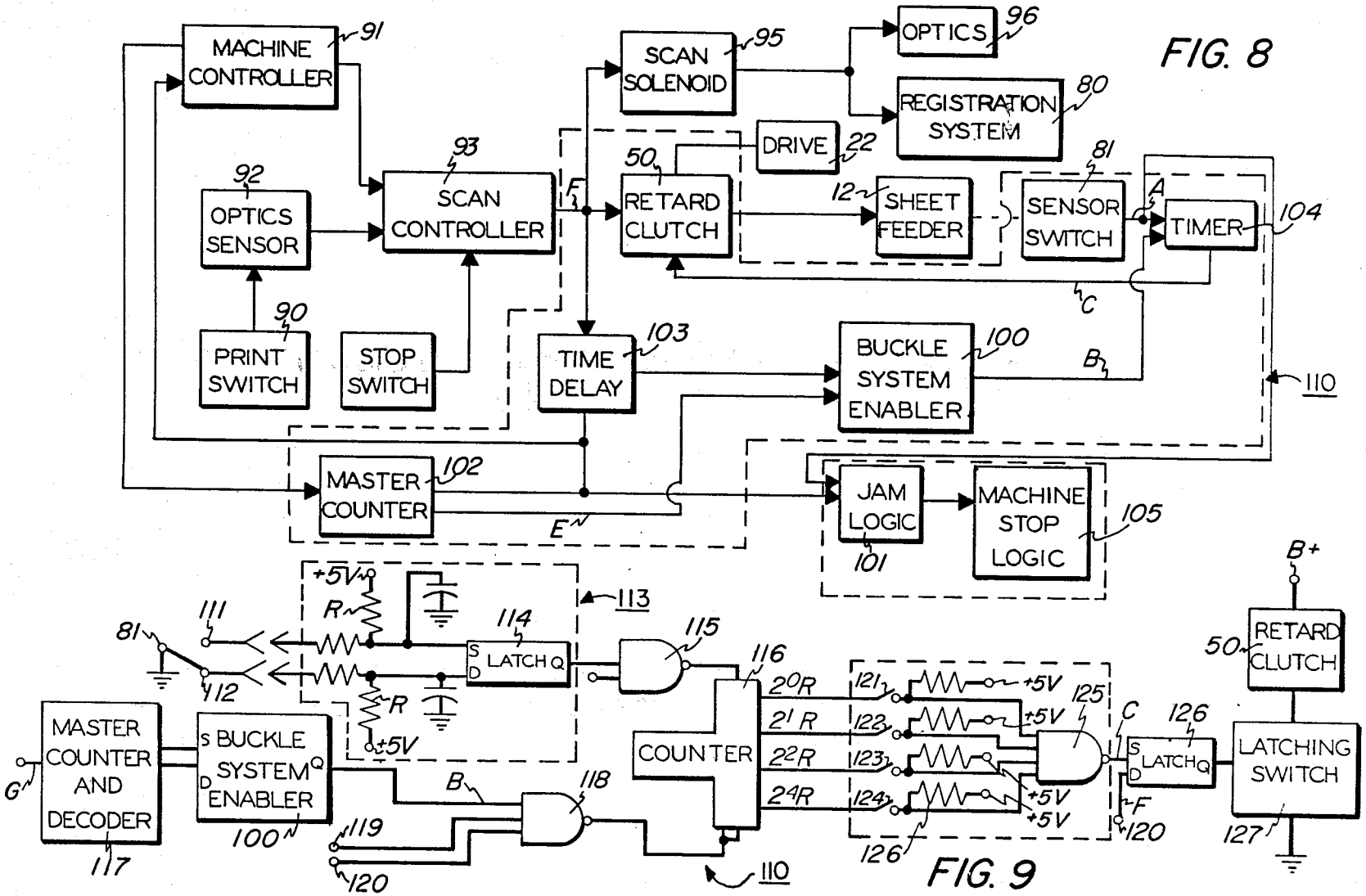
FIG. 8 is a flow diagram for the electrical buckle height control system.
FIG. 9 is a schematic diagram of the electrical buckle height control system of this invention.

FIG. 8 represents a flow diagram for a control system including an electronically timed buckle height control. FIG. 8 represents an approach which could be utilized, for example, with a Xerox "3,100" copying machine. That machine utilizes a scanning optical system for forming an image of an original document placed on a transparent platen. The optical image formed is then projected onto a xerographic drum. Further details of the process and apparatus will be described later by reference to FIG. 14.

Referring to FIG. 8, following actuation of the "print" switch 90 for the copier the machine control logic 91 and optics sensor 92 are initiated to provide optics ready and machine ready signals, respectively, to the scanning logic controller 93. This enables the scan controller 93 which in turn enables the retard clutch 50 coupling the drive 22 to the friction retard separator-feeder 12, and also enables the scan solenoid 95 which causes the optics system 96 to scan over its predetermined path and also cycles the registration system 80 for registering a copy sheet with respect to the image projected on the drum. Enabling the retard clutch 50 causes a sheet to be fed by the separator 12 which in turn actuates the sensor switch 81. Actuation of the sensor switch 81 provides a first signal A to the electronic timer 104 and also an optional signal to the machine jam detection logic 101.

The master counter 102 which controls the timing of the machine logic is coupled to a time delay logic circuit 103 to provide a time delay signal to the electronic buckle control system enabler 100 in order to prevent the enabler 100 from providing the enable signal B to the timer 104 prior to the clearing of the sensor switch 81 by the previously fed sheet. This time delay is set at a time interval long enough for the prior fed sheet to clear the sensor switch 81 before the timer is enabled and short enough such that the newly fed sheet will not reach the sensor switch before expiration of the enabler time delay interval. Following this time delay the buckle control system enable signal B is generated and upon the concurrence of the register switch 81 sense signal A the electronic timer 104 is actuated to count a reference time interval during which the separator 12 continues to feed the sheet to buckle it against the register gate 80. Upon expiration of the reference time interval the timer 104 provides a disable signal C to the retard clutch 50 to disengage the drive 22 from the separator 12.

The master counter 102 is reset to 0 after each copy is made by a suitably timed signal G from the machine controller 91. The master counter 102 generates a signal E at an appropriate count to reset the buckle system enabler 100.

Optionally the master counter 102 can also signal the jam logic 101 to enable it to interrogate the register sensor switch 81 during an appropriate time interval when a sheet should be present at the switch thereby ensuring that sheet feeding has occurred. Should the jam logic 101 not receive a register sensor switch signal so indicating, then a signal is generated by the jam logic to the machine disabling logic 105 to shut-off the machine. The jam logic and disabling logic may be of any conventional design. For example, one form of control logic for jam detection and machine disablement is described in U.S. Pat. No. 3,813,157, assigned to the assignee of the instant invention.

Referring now to FIG. 9, the elements of an electronic timer and buckle control system 110 from FIG. 8 which comprises the preferred embodiment of the invention is shown in greater detail.

The sensor switch 81, as shown, comprises a single pole double throw switch. Complementary output signals from the sensor switch appear at terminals 111 and 112 which comprise the inputs of a noise suppression circuit 113 which comprises the resistors and capacitors in a conventional arrangement as shown.

A D-latch 114 or flip-flop type circuit is included as part of the noise suppression circuit. The set and reset terminals of the latch 114 are coupled to the logic voltage supply by separate pull up resistors R. Thus, one of the input terminals of the latch is at a high logic level and the other is at a low logic level depending on the position of switch 81. Grounding a given terminal 111 or 112 by closing the switch generates a low level signal. In the embodiment shown the switch 81 has not been activated by a sheet being fed and, therefore, it is connected to the terminal 112 which provides a low signal at the reset terminal D of the latch 114 and a high signal at the set terminal. In this state the output of the latch 114 comprises a low signal. When a sheet is sensed the switch 81 connects terminal 111 to ground which causes the set terminal of the latch 114 to go low and thereby the output of the latch to go high. The output signal of the latch 114 is applied to one input of a NAND gate 115. The other input of the gate 115 is tied to a 60 Hz. line. This NAND gate is operative to gate in a 60 Hz. train of clock pulses to a binary ring counter 116.

The master counter and decoder 117 which includes elements 102 and 103 from FIG. 8 is utilized to set and reset a D-latch type flip-flop which comprises the buckle system enabler 100. As previously described, the setting signal for the enabler 100 is decoded after a suitable time delay. The reset signal is generated when the master counter and decoder 117 decodes a desired count corresponding to a desired time interval for resetting the enabler. The output of the enabler D-latch 100 is high when it is set and low when it is reset. The output is applied to one input of a NAND gate 118. A second input to the NAND gate 118 is received through terminal 119 from the machine controller 91 of FIG. 8, and comprises a cycle-up disable signal which is low when the machine is cycling from its stand-by condition to a machine ready condition and which is high when the machine reaches the machine ready condition. A third input to this NAND gate 118 is received through terminal 120 from the machine controller and comprises a cycle-out disable signal which is low when the machine is cycling from its machine ready condition to its machine stand-by dondition, and is high when the machine is in the machine ready condition. Upon the concurrence of high signals at each of the inputs to the NAND gate 118 a low signal is generated which enables the counter 116. The counter 116 then counts the clock pulses which are gated to it from the NAND gate 115 under the conditions previously described.

If desired, machine status need not be considered and a suitable inverter circuit of conventional design could be employed instead of the NAND gate 118 to change the output of the enabler flip-flop 100 from a high to a low for enabling the counter.

Four outputs from the binary ring counter 116 corresponding to desired binary numbers are applied through switches 121–124 to respective inputs of a NAND gate decoder 125. Pull up resistors 126 are provided in each input line between the switch and the decoder 125 input to provide high signals at a given input if the switch in the respective line is open. By opening or closing the switches 121–124, one can decode any desired count within the range of the counter to provide an output signal from the decoder 125 indicating the end of the reference time interval. The use of the in line switches, as shown, therefore enables the reference time interval of the timer 104 to be adjusted as desired. For the counter shown, time intervals from 0 to 15 counts can be decoded which would correspond to a time interval of 0 to 0.25 seconds. For example, to decode a count of 8, switch 124 would be closed and the others left open, while for a count of 15, all of the switches 121–124 would be closed.

The output signal from the NAND gate decoder 125 which comprises the end of the reference time interval signal is applied to set the input terminal of a D-latch 126 type flip-flop. The D-latch 126 is reset by a signal F received at terminal 128 from the scan controller 93 which is set forth in FIG. 8. The output of the D-latch 126 is applied to a suitable latching switch circuit 127 which may be of any conventional design such as, for example, one employing a silicon controlled rectifier. The output of the latching switch is effective to enable or disable the retard clutch. Resetting the D-latch 126 causes the latching switch to enable the retard clutch 50 whereas setting the latch disables the clutch.

FIG. 10 shows a typical timing diagram for the buckle height control system 110 of this invention. Actuation of the print switch 90 for the copier at time $t_0$ enables the retard clutch for initiating sheet feeding. After a predetermined time delay $t_1$-$t_0$ during the sheet feeding –the buckle system enabler D-latch 100 is enabled at time $t_1$. The lead edge sensor switch 81 is then actuated at time $t_2$ to start the timer 104 and following the expiration of the reference time interval $t_3$–$t_2$ at time $t_3$ the timer disables the retard clutch. At time $t_4$ the buckle system enabler latch 100 is reset by the master counter 117. At time $t_5$ the sheet clears the sensor switch 81. When a second copy is initiated at time $t_0'$, the previously described timing cycle is repeated.

Having thus formed a forward buckle in the sheet against the registration gate 80 it is now necessary to feed the sheet to the nip of the registration rolls 24 and then to an imaging member I. Since a relatively high buckle has been formed in the sheet, it has been found necessary and desirable in order to obtain sheet feeding without a high propensity for jamming to assist the buckle in flattening out as the sheet is fed by the registration roller.

Figure 11A:
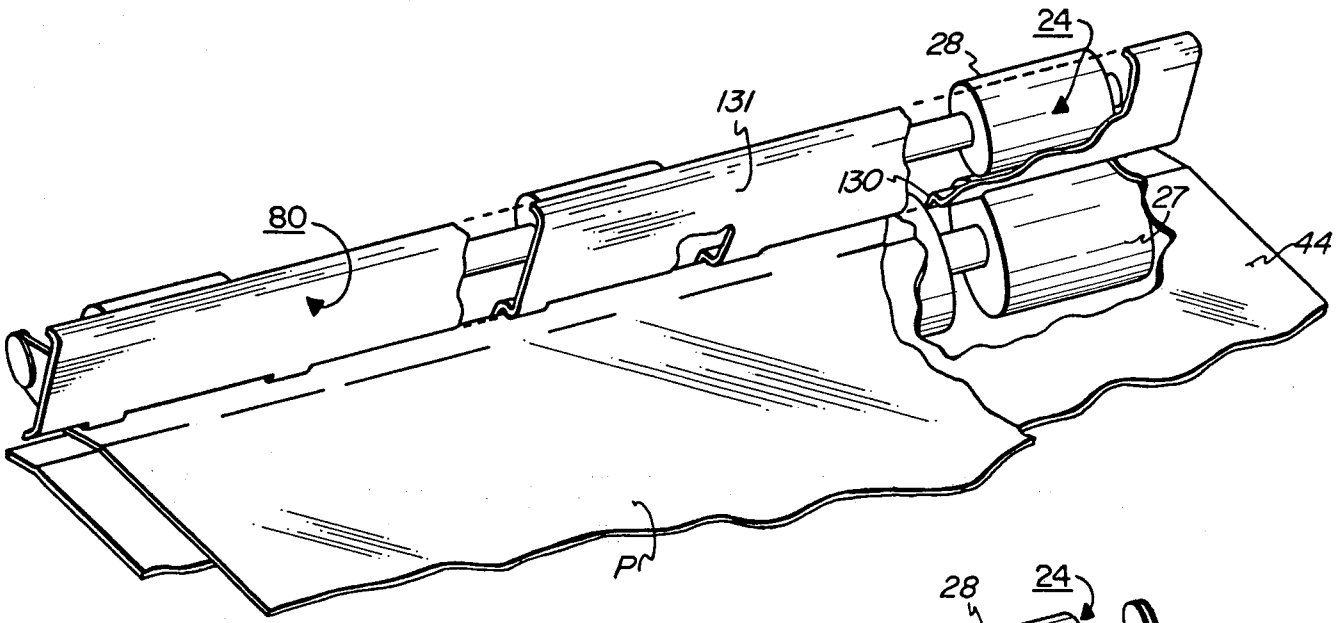
FIGS. 11A and 11B are a series of perspective views illustrating the pivoting registration gate paper chute of this invention.
Figure 11B:
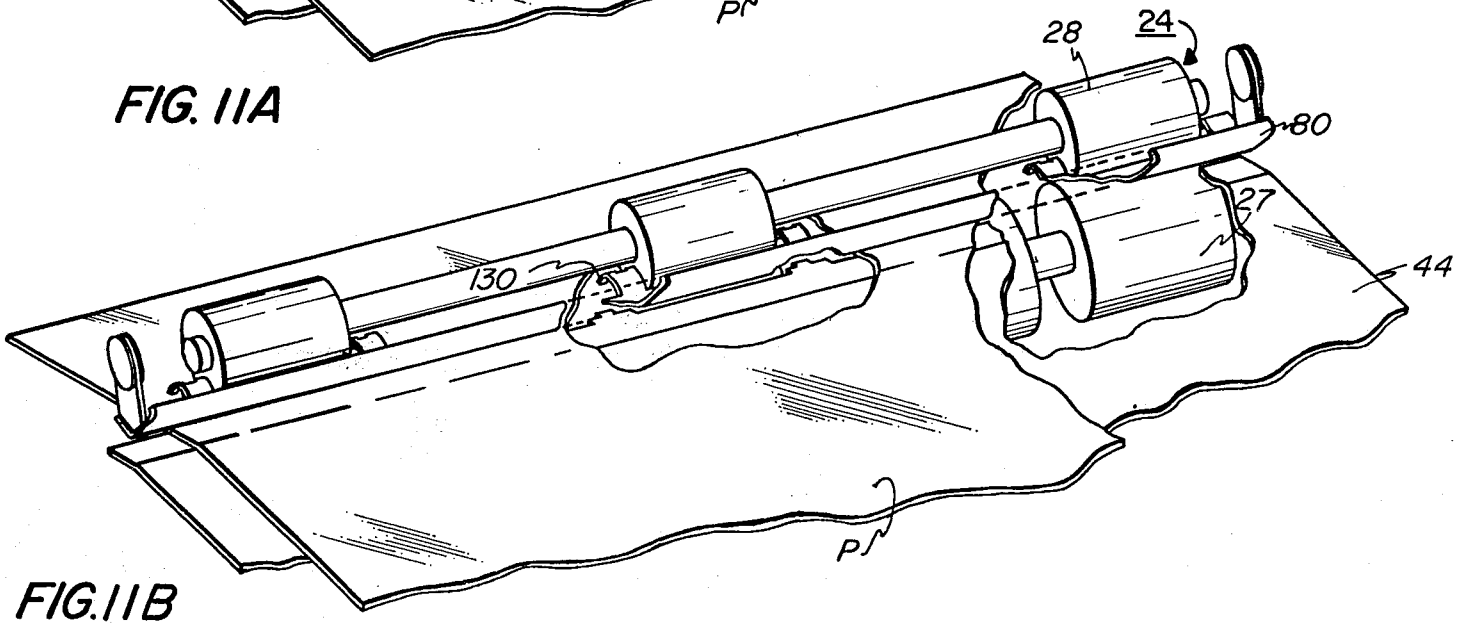

As shown in FIGS. 7 and 11, the lead edge of the sheet P at the time it intercepts the registration gate 80 rests upon the lower registration rolls 27. The lower registration rolls have a diameter which is greater than the diameter of the upper registration rolls 28. The gate 80 in its sheet blocking position is located just upstream of the nip of the rolls 24, and close enough to the nip so that the lead edge of the sheet as it engages the gate can rest against the lower registration rolls. Since the rolls 24 are driven continuously the effect of this arrangement is to have an assisting force applied to the lead edge of the sheet to keep it in engagement with the gate 80 as the gate pivots the lead edge into the nip of the rolls 24. Further, this registration roll assist also aids sheet feeding following the registration cycle, since the sheet is already being acted upon by the lower rolls 27 during the registration cycle.

The registration gate 80 shown in FIGS. 7 and 11, also operates as an upper paper chute for the registration rolls 24. It extends substantially across the sheet. The portions of the gate 80 which engage the lead edge of the sheet during registration comprise tabs 130, the remaining plate-like face portion 131 of the gate comprises the paper chute. As previously noted, the lower registration roll assist helps to maintain engagement between the lead edge of the sheet and the tabs 130. The downstream side of the buckle which is formed in the sheet engages the chute portion 131 of the registration gate 80. In the embodiment shown, both the chute portion 131 and tab portions 130 are formed as a single piece. Since the chute portion 131 pivots as the sheet P passes into the nip of the registration rolls 24 an assisting action on the front portion of the sheet is provided to help carry it into the registration rolls so as to reduce the tendency of the sheet to jam. If the chute portion 131 were stationary and only the tabs 130 pivoted, then there would be a higher propensity for jamming. By pivoting both the upper chute portion 131 and the registration tabs 130 jam propensity is substantially reduced. This occurs because the chute portion which engages the buckle is moving in substantially the same direction as the sheet thereby reducing the tendency of the sheet to bind against the chute.

To further assist in flattening out the buckle, as shown in FIG. 7, a plurality of transversely (normal to the plane of the Figure) spaced apart buckle assist members 140 act on the upstream side of the buckle to push and flatten the buckle as the sheet P is fed by the registration rolls 24. The assist members comprise elongated elements pivoted so as to be biased against the rearward or upstream side of the buckle. The elements shown are formed of metal and are biased by their own weight. Their weight provides sufficient assisting force to provide the operative characteristics required. Alternatively, the buckle assist members could comprise resilient strips 141 formed of Mylar or other suitable material which could be mounted in cantilever fashion as in FIG. 14. As the buckle forms, it deflects the strips 141 in a spring-like fashion. The strips then act like cantilever springs to force the buckle to flatten as the sheet is being fed by the registration rolls. The use of Mylar fingers is a highly effective approach when two feeders are employed which feed to the same registration roll 24 and gate 80 arrangement.

Figure 15B:
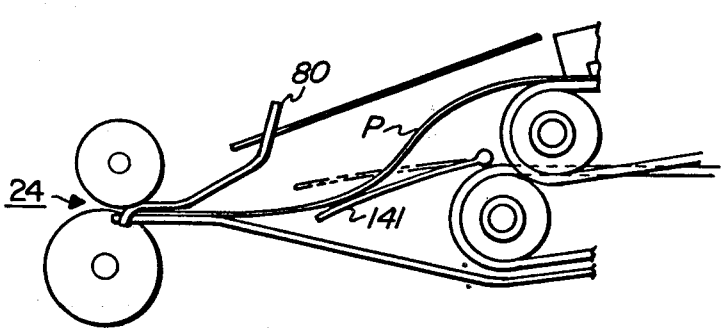
FIGS. 15A and 15B are a series of partial side views illustrating the operation of the feeders of FIG. 14.
Figure 15A:
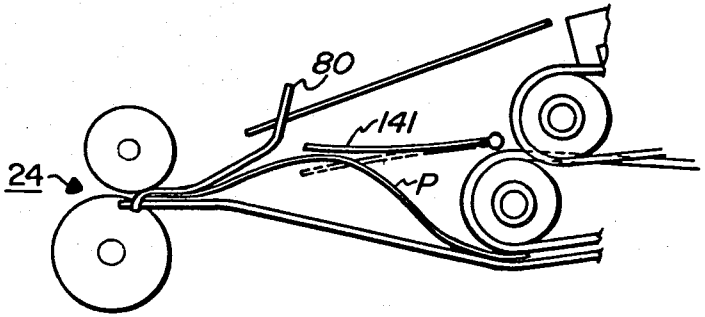

Referring to FIG. 15*a*, when the top feeder 150 is feeding the sheet P into the registration gate, the Mylar strip 141 is deflected upwardly by the upwardly forming buckle and as the sheet is fed out by the registration rolls 24 it acts upon the buckle to flatten it out. As shown in FIG. 15*b*, when the bottom feeder 160 is feeding, the Mylar strip 141 is deflected in the opposing or downwardly direction by the downwardly forming buckle and acts against the buckle to flatten it out as the sheet P is fed.

Figure 12:
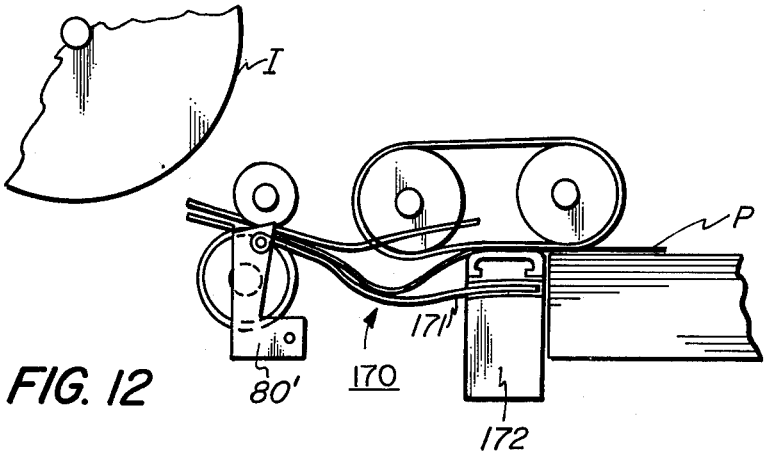
FIG. 12 is a partial side view of an alternative embodiment of buckle assisting mechanism of this invention.
Figure 13:
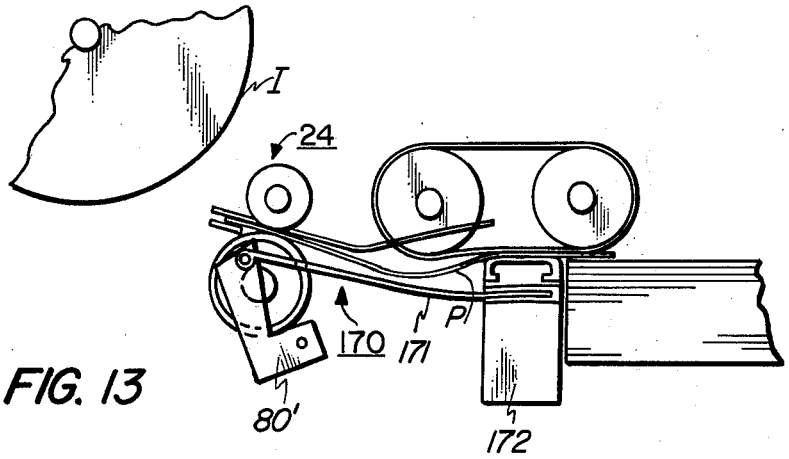
FIG. 13 is a partial side view of the alternative embodiment of FIG. 12 illustrating its operation.

Referring now to FIGS. 12 and 13, yet another buckle flattening arrangement 170 is shown. In this embodiment the sheet feeder is positioned adjacent a xerographic drum I. The registration gate 80' is positioned below the sheet feed path. This gate 80' is also a pivoting type gate which directs the lead edge of the sheet into the nip of the registration rolls 24. A flexible sheet or multiple strip like member 171 is connected between the gate 80' and the retard pad supporting member 172. The member 171 thereby forms the lower paper chute. When the gate 80' is in its operative position to block sheet passage, there is sufficient slack in the flexible member 171 to allow the formation of a downwardly facing buckle. This would be the preferred approach since it allows easy access to the sheet for jam clearance. However, this concept could be applied to an upwardly buckling arrangement if desired. Following buckle formation, as shown in FIG. 13, to feed the sheet P and flatten the buckle, the registration gate is pivoted out of its operative blocking position to its inoperative position below the sheet feed path and the slack in flexible member 171 is taken up so that the member is held taut between the gate 80' and the retard pad support member 172. The action of taking up the slack in the member 171 assists in flattening the buckle in the same manner to the concepts previously described.

Referring again to FIG. 7, it is apparent that a sheet P being fed by the friction retard separator 12 upon being engaged by the registration rolls 24 is still held within the nip of the friction retard separator. This arrangement, which is desirable when the sheet feeder 12 is to be employed in a compact environment wherein there is insufficient room to separate the sheet registration and separation functions by more than the length of a sheet, can result in significant problems due to the interaction of these functions. The frictional engagement between the registration rolls 24 and the sheet and the torque supplied to the registration rolls must be sufficient to overcome the nip drag between the belt feeder 17 and the retard pad 38 even though the belt feeder is free wheeling since clutch 50 is disengaged and also the drag force between the belt feeder and the stack P'.

One approach which could be employed to reduce the nip force between the belt feeder 1y and the retard pad 38 would be to separate the nip of the separator 12 when the registration rolls feed the sheets P. However, this destroys the queing and shingling function of the separator design 12 which is preferred. It is desirable in accordance with this invention to maintain the closed nip of the separator 12 and the retard pad in order to keep the appropriate queing throat and shingling of the sheets in the throat. Therefore, it has been determined that the best approach for reducing the drag on the sheet P as it is being fed by the registration rolls 24 would be to reduce the drag due to the normal force of the belt feeder 17 against the stack P'.

A specific approach for carrying this out has been devised which is extremely simple in nature. It has been noted that the friction retard separator 12 of this invention including the feed belt 17 and retard pad 38 are pivoted about the axis of shaft 14. Referring to FIG. 6, the drive pulley 19 rotates in a clockwise direction to advance the timing belt 20 and separator belt 17 as shown by arrows 180 and 181. This results in an increase in normal force exerted by the feeder 17 during feeding due to the addition of an assisting pick force.

The assisting pick force which has been described is believed to be a result of a reaction torque or resistance torque about the pivot 14 of the separator 12. The normal assisting force component contributed by this resistance torque is a function of the input torque about the pivot point 14, the length of the moment arm between the pivot point and the point of application of the normal force to the stack P' and the frictional resistance encountered by the belt 17. The drive direction about the pivot point 14 should be in a direction so as to cause the pick force to be exerted against the stack P' rather than away from it. For example, if the feeder 17 were rotated about the pivot 14 in the same direction as the drive input 19, it should rotate against the stack.

In accordance with this invention, the normal force with which the feeder 17 engages the stack P' during feeding is comprised of two components, the first component comprises the normal force which would be exerted by the belt feeder 17 against the stack when it is not being driven which can vary from zero up to any desired level. In the embodiment of FIG. 1 this comprises the weight of the separator 12 frame 13, etc., as counterbalanced by the spring 190. This component can be relatively low, namely, a force sufficient to maintain friction contact between the belt feeder 17 and the top of the stack. Upon driving the belt feeder, an additional component of normal force is imparted due to the resistance torque moment previsouly described. This component in the embodiment shown in FIG. 6 is substantially greater than the force of the first component. Further, this component is self-compensating.

The amount of the resistance torque moment is believed to be a function of the frictional resistance which the belt encounters when it is being driven. A major component of the frictional resistance is due to the nip friction between the belt and the retard pad and a lesser component of the frictional resistance is due to the friction between the belt and the top sheet of the stack. The self-compensating effect results as follows: If the sheets in the stack are not shingled in the nip of the separator the frictional engagement between the retard pad 38 and the belt 17 will be high, thereby resulting in a high resistance torque and correspondingly high normal assisting force applied to the stack. Thus, the higher normal force required to separate and feed a sheet from the stack would automatically be provided by the feeder as proposed herein. There can be a reduction in normal force applied where a sheet has already been shingled between the nip of the belt and the retard pad. In this instance, to feed the sheet a lower degree of normal force is required since it has already been separated from the stack. Since the sheet P has been shingled in the nip between the retard pad 38 and the belt feeder 17, the frictional resistance of that nip has been reduced, and consequently the normal assisting or pick force component due to the resistance torque about the pivot is also reduced. It is apparent then that the use of the pick force herein as a normal assisting force during feeding provides substantial advantages in enabling one to obtain automatic compensation in normal force for feeding sheets under different conditions.

The amount of the normal force which results from this additional resistance torque component can be adjusted by adjusting the input torque about the pivot 14 and/or by adjusting the length of the moment arm between the pivot and the point of application of the normal force.

While the use of this pick force has been shown by reference to the use of a friction retard separator of the belt and pad type, it should be apparent that it could also be utilized with a friction retard separator of the roll type such as the one described in U.S. Pat. application, Ser. No. 398,024, filed Sept. 17, 1973, now U.S. Pat. No 3,883,133 and assigned to the assignee of the instant invention.

If desired, the normal assisting force can be further augmented by locating the feeder pivot 14 outwardly of the plane of the sheet being fed as in U.S. Pat. No. 3,048,393 to Furr et al. This configuration gives a pick force due to the frictional resistance between the feeder and the sheet, however, it varies with stack height.

The actual speed of the belt feeder may be modified from the input torque supplied the pulley 19 by any desired means such as the use of varying sized pulleys 18, suitable gearing or the like. It is essential, however, that the drive about the pivot be in the proper direction, and, therefore, it may be necessary to include additional idler gears or the like to provide the appropriate input drive direction.

The sheet separator 12 mounted as described is adapted to apply a first high initial normal force against the stack P′ during feeding by the separator and then a substantially lower normal force when the sheet P is being fed by the registration rolls 24. This substantially reduces the drag of the feeder on the sheet as it is fed by the registration rolls 24.

Referring to FIG. 14, the applicability of the pick force principle to a bottom feeder 160 is also shown. In FIG. 14 two feeders 150 and 160 are employed. A top feeder 150 is provided substantially as previously described with a difference being that the belt feeder 17′ includes an extra idler pulley 151 so that the circumference of the belt is the same as the circumference of the belt utilized on the bottom feeder 160. The belt portion between the idler pulley 151 and the rear belt pulley 16′ operates as previously described. The feed belt 17′ and retard pad 38 are pivoted as previously described about axis 14′.

For the bottom feeder 160, however, wherein the belt 17″ feeds from the bottom of the stack P′ a greater portion of the feed belt between idler pulleys 161 and 162 engages the bottom sheet to provide more efficient feeding. This is a similar approach to that described in U.S. Pat. application Ser. No. 342,653, filed Mar. 19, 1973. The bottom feeder feed belt 17″ and retard 38″ assembly are pivoted about a drive shaft 163 against the stack P′. The input drive gear 164 which meshes with drive gear 48 (not shown) rotates in a counterclockwise direction. The rear pulley 16″ of the feeder 17″ is driven from the input drive gear 164 by a pulley and timing belt arrangement similar to that previously described with reference to the feeder 17 of FIG. 6. In this manner a pick force or normal assisting force is generated during feeding. The pick force increases the normal force exerted against the bottom of the stack substantially above that due to the spring biasing 165 of the feeder head 17″ and 38″.

In the case of the top feeder 150 the stack support tray provides a stop against which the pick force action of the belt feeder 17′ operates. In the case of the bottom feeder 160 tray, however, no such stack stop is provided.

Therefore, in accordance with this invention, an adjustable stop means 200 is provided against which the feed belt 17″ acts. The adjustable stop means 200 comprises a pivoting lever 201. The lever 201 has a pad 202 at one end for contacting the stack P′ above the feed belt 17″. The other end the lever is secured to a shaft 203 through a one way clutch 204 which can be overridden by a desired degree of force which is selected to be greater than the normal pick force exerted by the bottom feeder 17″. The one way clutch 204 permits the lever 201 to move easily toward the stack but will not allow it to move away from the stack except by slipping upon the application of a relatively high force substantially greater than the pick force exerted against the stack by the feeder 17. In operation the adjustable stop lever 201 is raised to load a sheet stack and is then lowered against the stack. When a sheet P is being fed the high normal force due to the pick force component acts against the pad 202 and lever 201 which restrains the stack from moving and allows the increase in normal force to be applied to the stack. The bottom feeder itself is biased with a low level of normal force against the bottom of the stack by spring 165 even when no pick force is provided.

It is a unique aspect of this invention that two sheet feeders 150 and 160 can be provided which feed sheets to a single set of registration rolls 24 wherein a sheet fed from either feeder to the registration rolls is still in its respective sheet separator at the time it is first fed by the registration rolls. This is possible only because of the highly compact nature of the sheet feeding apparatus of this invention.

It should also be apparent that the belt feeders 17′ and 17″ for the top feeder 150 and the bottom feeder 160 in FIG. 14 are off-set from one another in a direction transverse to the feeding direction.

One of the difficulties that arises when using a single point separator 12 such as the friction retard separator herein and multiple registration rolls 24 such as previously described is an uneven force distribution in the sheet due to the uneven tension in the sheet between the registration rolls and the separator. This is belt illustrated by reference to FIG. 16*a*. As the registration rolls 24 begin to advance the sheet P and pull it from the nip of the separator 12, a force pattern is created as shown in FIG. 16*a*. This force pattern is quite non-uniform because of the fact that the registration rolls extend across the transverse width of the sheet whereas the separator is virtually at a single point. The result of this non-uniform force distribution is a wrinkling of the sheet as it is being fed by the registration rolls as shown in FIG. 16*b*. Feeding a sheet with a wrinkled lead edge or wavey lead edge to an imaging member I results in deletions in the resulting copy sheet where the sheet did not come into contact with the imaging member due to its wavey surface. These deletions extend like fingers in from the lead edge of the sheet and may be characterized as finger-type deletions.

One approach to solving this problem is illustrated in FIG. 7 and comprises a bump 210 in the bottom of the lower paper chute 43 which extends between the separator and the registration rolls. The bump preferably should be relatively sharp to cause a deflection in the sheet being fed which also helps to initiate buckling. As the sheet P is being fed by the registration rolls 24 while still being held in the separator nip the bump results in a sharp bend 210' in the sheet as shown in FIG. 17*a*. The effect of this bend in the sheet is to provide a more uniform force distribution between the bend and the registration rolls since the rolls pull against the line-like bump 210. An uneven force distribution still would exist between the separator 12 and the bend 210' in the sheet P caused by the bump 210. The result of the bend in the sheet, as shown in FIG. 17*b*, is to provide a sheet without lead edge ripples or wrinkles and thereby reduce or eliminate the finger-type deletions previously described.

Yet another approach to eliminating wavey or wrinkled lead edges for the sheet P being fed by the registration rolls 24 is shown in FIG. 18*a*. In accordance with this approach the registration rolls 220 and 221 which contact the sheet near the opposing side edges of the sheet are toed out. They are canted in generally opposing directions with respect to the axis of the upper registration roll shaft 222. The registration roll 221 on the right side of the sheet has its axis of rotation canted or toed out to the right with respect to the axis of shaft 222 and the registration roll on the left side of the sheet has its axis of rotation canted or toed out to the left with respect to the axis of shaft 222. The canting of the rolls 220 and 221 may be obtained by providing an eccentric bushing (not shown) for the shaft 222 about which the rolls rotate. The details of this structure need not be shown since any desired approach for toeing out the rolls 220 and 221 could be employed including bending the shaft 222 to the desired canting angle. In the apparatus shown only the outer top idler rolls 220 and 221 are toed out and the bottom rolls 27 which are driven are not toed out. If desired, both sets of rolls could be canted. However, it has been found that canting only the outer top rolls provides adequate results. The effect of toeing out the rolls 220 and 221 is for each roll to impart a force directed laterally outwardly of the sheet feed direction on each side of the sheet so as to cause any wrinkles or waveness in the sheet to be flattened out by placing the sheet under tension along its transverse width. The center registration roll 28 is shown, but need not be employed. If a center roll is employed, it has been found desirable to mount it so that it is not toed out in either direction, but rather so that it is journaled concentrically with the axis of shaft 222.

It has been found that if a sheet is fed by the separator without the benefit of the front portion 43' of the lower paper chute that wrinkling of the leading portion of the sheet can result. The portion of the sheet acted upon by the separator follows the curved path of the separator nip while the remaining portions of the sheet tries to go in a straight path due to its inherent beam strength. This can cause the leading portion of the sheet to wrinkle.

To eliminate this problem the portion 43' of the lower chute 43 substantially co-extensive with the separator 12 is shaped to substantially conform along its transverse width to the shape of the separator nip. This portion along with the upper chute 70 causes the entire sheet to follow the arcuate path of the separator nip and thereby reduces any propensity for wrinkling the sheet.

The shape of the portion 43' is similar to, but need not be identical to the shape of the nip. It should have a sufficiently curved shape to guide the sheets over their transverse width through substantially the same curved path as the nip.

Referring again to the use of pick force as a normal assisting force during feeding, it has been found that particularly with a bottom feeder the first normal force preferably is zero if desired and the entire normal force which the feeder exerts against the stack should preferably comprise the assisting force. This approach can also be applied to a top feeder by providing sufficient counterbalancing to completely overcome the weight of the feeder head. It has been found, however, that the application of a small first normal force with the top feeder provides good results.

The pick force generated in accordance with the feeding arrangement of this invention provides a very useful side effect which comprises the breaking of the lead edge of the stack due to its cyclic loading with the relatively high pick force.

To further illustrate the use of pick force as a normal assisting force the following calculated example is presented for a feeder as shown in FIG. 6 having the following parameters:

1. The moment created by the weight of the pivoting feeder head is about 1.15 inch pounds.
2. The bearing friction which is assumed to occur solely at pulley 16 is about .097 inch pounds.
3. The distance from the pivot axis 14 to the point of contact with the stack in the horizontal direction is about 4.56 inches and in the vertical direction is about 0.45 inches.
4. The wrap angle of the belt 17 about the retard pad 38 is about 23.3°.
5. The initial belt tension is about 1.5 lbs.
6. That the diameter of pulley 19 is twice the diameter of the drive hub of pulley 16 about the shaft 15, and that the diameter of the pulley 16 is about 0.915 inches.
7. The belt to retard pad coefficient of friction is about 1.58; the paper-to-paper coefficient of friction is about 0.6, and the paper-to-retard pad coefficient of friction is about 1.1.

Based on the above parameters, the following force levels have been calculated. The normal force exerted by the feeder against the stack when it is not running is about 0.25 pounds. In operation the assisting pick force raises the normal force to about 0.65 pounds when no sheet is shingled in the nip of the separator or to about 0.42 pounds if a sheet is shingled in the nip. This illustrates the self-compensating effect of the picking action of this invention.

In addition to the forces calculated above, the following forces were calculated with respect to the drag force required to pull a sheet from the above feeder when it is not running and the belt 17 is free wheeling.

The bearing drag force is about 0.21 lbs.

The feed belt to stack drag force is about 0.151 lbs.

The retard pad to belt nip drag force is about 0.666 lbs.

Providing a total drag force of about 1.03 lbs.

It is apparent that the drag force at the nip of the separator is more than 4 times greater than the drag force between the feed belt and the stack. Therefore, the pick force which is generated is principally a function of the nip friction.

It should also be apparent that if the full normal force were applied to the feeder head instead of using a pick force assist then the belt-to-stack drag force would be significantly higher.

This example is meant to illustrate, but one embodiment of this invention and is not intended to be limitive of the invention. Feeders employing the principles disclosed herein can utilize a wide range of parameters to get desired force levels and other characteristics.

The sheet feeding apparatus 10 of the present invention is uniquely suited for use in a reproducing machine, particularly reproducing machines of the xerographic type. Its highly compact nature allows one to substantially reduce the space required for the sheet feeder. While the sheet feeders of this invention may be used with any desired reproducing machine, a xerographic type reproducing machine will be described by reference to FIG. 14.

Referring now to FIG. 14 there is shown by way of example an electrostatographic reproducing machine 230 which incorporates an improved sheet feeding apparatus 10 of the present invention. The reproducing machine 230 depicted in FIG. 14 illustrates the various components utilized therein for xerographically producing copies from an original. Although the sheet feeding apparatus of the present invention is particularly well adapted for use in an automatic xerographic reproducing machine 230, it should become evident from the following description that it is equally well suited for use in a wide variety of electrostatographic systems and other reproducing machines and is not necessarily limited in its application to the particular embodiment shown herein.

The reproducing machine illustrated in FIG. 14 employs an image recording drum-like member 231, the outer periphery of which is coated with a suitable photoconductive material. One type of suitable photoconductive material is disclosed in U.S. Pat. No. 2,970,906, issued to Bixby in 1961. The drum 231 is suitably journaled for rotation within a machine frame (not shown) by means of a shaft 232 and rotates in the direction indicated by arrow 233 to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet P of final support material such as paper or the like.

The practice of xerography is well-known in the art, and is the subject of numerous patents and texts, including Electrophotography by Schaffert, published in 1965, and Xerography and Related Processes, by Dessauer and Clark, published in 1965. The various processing stations for producing a copy of an original are herein represented in FIG. 14 as blocks 234–239.

Initially the drum 231 moves photoconductive surface through charging station 234. In charging station 234 an electrostatic charge is placed uniformly over the photoconductive surface of the drum 231 preparatory to imaging. The charging may be provided by a corona generating device of a type described in U.S. Pat. No. 2,836,725, issued to Vyverberg in 1958.

Thereafter, the drum 231 is rotated to exposure station 235 where the charged photoconductive surface is exposed to a light image of the original input scene information, whereby the charge is selectively dissipated in the light exposed regions to record the original input scene in the form of a latent electrostatic image. A suitable exposure system may be of the type described in U.S. Pat. application, Ser. No. 259,181, filed June 2, 1972.

After exposure, drum 231 rotates the electrostatic latent image recorded on the photoconductive surface to development station 236 wherein a conventional developer mix is applied to the photoconductive surface of the drum 231 rendering the latent image visible. A suitable development station is disclosed in U.S. Pat. No. 3,707,947 issued to Reichart in 1973. This patent describes a magnetic brush development system utilizing a magnitizable developer mix having carrier granules and a toner colorent. The developer mix is continuously brought through a directional flux field to form a brush thereof. The electrostatic latent image recorded on photoconductive surface is developed by bringing the brush of developer mix into contact therewith.

The developed image on the photoconductive surface is then brought into contact with a sheet P of final support material wherein a transfer station 237 and the toner image is transferred from the photoconductive surface to the contacting side of the final support sheet. The final support material may be paper, plastic, etc., as desired. After the toner image has been transferred to the sheet of final support material the sheet with the image thereon is advanced to a suitable fuser 238 which coalesces the transferred powder image thereto. One type of suitable fuser is described in U.S. Pat. No. 2,701,765, issued to Codichini, et al in 1955.

Although a preponderance of the toner powder is transferred to the final support material P, invariably some residual toner remains on the photoconductive surface after transfer. The residual toner particles remaining on the photoconductive surface after transfer are removed from the drum 231 as it moves through cleaning station 239. Here the residual toner particles are first neutralized and then mechanically cleaned from the photconductive surface by conventional means as, for example, the use of a resiliently biased knife blade as set forth in U.S. Pat. No. 3,660,863, issued to Gerbasi in 1972.

It is believed that the foregoing description is sufficient for purposes of the present application to illustrate the general operation of an automatic xerographic copier which can embody the teachings of the present invention. Unless otherwise specified or shown, shafts and other members are suitably supported in appropriate machine frames by any desired conventional means.

The patents, patent applications and texts specifically set forth in this application are intended to be incorporated by reference into the description.

The term electrostatographic as employed in the present application refers to the formation and utilization of electrostatic charge patterns for the purpose of recording and reproducing patterns in viewable form.

It is apparent that there have been provided in accordance with this invention apparatuses which fully satisfy the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a sheet feeding and separating apparatus for feeding and separating individual sheets from a stack of sheets including: sheet feeding and separating means comprising an endless sheet feeding and separating belt having a deformable unsupported section and retard means comprising a member having a frictional retard surface which deformably engages said feed belt in said unsupported section to form a nip for sheet advancement therebetween and a sheet queing throat, the improvement comprising:

means responsive to the direction in which said sheet is moving through said nip for providing a first relatively high nip force between said retard means and said feeding means when said sheet is moving in the sheet feeding direction and for substantially reducing said nip force as compared to said first force when said sheet is moving in a second direction generally opposed to the sheet feeding direction for allowing removal of sheets from said nip, said first force comprising a desired force level for obtaining proper sheet separation.

2. An apparatus as in claim 1 wherein said frictional retard surface is finitely curved.

3. An apparatus as in claim 1, wherein said retard member is mounted for toggling engagement with said feed belt.

4. An apparatus as in claim 3, wherein said retard member is pivotally mounted about an axis transverse to the sheet feeding direction, the pivot axis being located downstream of the center of said retard member when viewed in the sheet feeding direction, whereby when a sheet is fed in said sheet feeding direction, the retard member pivots against said feed belt to further deflect the unsupported section and increase the nip force to the first level, and when a sheet is removed from the nip in the generally opposing direction the retard member pivots in the opposing direction to decrease the deflection of the belt and thereby provide the reduced nip force.

5. An apparatus as in claim 4, including adjustable means for limiting the degree to which said retard member can pivot in either direction about said axis.

6. In a reproducing apparatus including an imaging means for forming an image on a sheet, means for feeding and separating individual sheets from a stack of sheets and feeding them to said imaging means, said sheet feeding and separating means comprising an endless sheet feeding and separating belt having a deformable unsupported section and retard means comprising a member having a frictional retard surface which deformably engages said feed belt in said unsupported section to form a nip for sheet advancement therebetween and a sheet queing throat, the improvement comprising:

means responsive to the direction in which the sheet is moving through said nip for providing a first relatively high nip force between said retard means and said feeding means when said sheet is moving in the sheet feeding direction and for substantially reducing said nip force as compared to said first force when said sheet is moving in a second direction generally opposed to the sheet feeding direction for allowing removal of sheets from said nip, said first force comprising a desired force level for obtaining proper sheet separation.

7. An apparatus as in claim 6, wherein said frictional retard surface is finitely curved.

8. An apparatus as in claim 6, wherein said retard member is mounted for toggling engagement with said feed belt.

9. An apparatus as in claim 8, wherein said retard member is pivotally mounted about an axis transverse to the sheet feeding direction, the pivot axis being located downstream of the center of said retard member when viewed in the sheet feeding direction, whereby when a sheet is fed in said sheet feeding direction, the retard member pivots against said feed belt to further deflect the unsupported section and increase the nip force to the first level, and when a sheet is removed from the nip in the generally opposing direction the retard member pivots in the opposing direction to decrease the deflection of the belt and thereby provide the reduced nip force.

10. An apparatus as in claim 9, including adjustable means for limiting the degree to which said retard member can pivot in either direction about said axis.

11. In a sheet feeding and separating apparatus for feeding and separating individual sheets from a stack of sheets including: sheet feeding and separating means and retard means engaging said feeding means to form a nip for sheet advancement therebetween said feeding means comprising an endless sheet feeding and separating belt having a deformable unsupported section and said retard means comprising a member having a frictional retard surface which deformably engages said feed belt to deflect said belt in said unsupported region, the improvement comprising:

means responsive to the direction in which said sheet is moving through said nip for urging said retard member against said belt to deflect said belt in said unsupported region to a desired extent when a sheet is moving in the sheet feeding direction and to substantially reduce the deflection of said belt when a sheet is moving in a direction generally opposed to the sheet feeding direction and adjustable means for limiting the amount of deflection of said feed belt when said sheet is moving in said sheet feeding and generally opposing directions.

12. An apparatus as in claim 11, wherein said frictional retard surface is finitely curved.

13. An apparatus as in claim 11, wherein said retard member is mounted for toggling engagement with said feed belt.

14. An apparatus as in claim 13, wherein said retard member is pivotally mounted about an axis transverse to the sheet feeding direction, the pivot axis being located downstream of the center of said retard member when viewed in the sheet feeding direction, whereby when a sheet is fed in said sheet feeding direction, the retard member pivots against said feed belt to further deflect the unsupported section and increase the nip force to a first level, and when a sheet is removed from the nip in the generally opposing direction the retard member pivots in the opposing direction to decrease the deflection of the belt and thereby provide a reduced nip force.

15. An apparatus as in claim 11, further including means for forming an image on said sheets.

* * * * *